US005152603A

United States Patent [19]

Lee

[11] Patent Number: 5,152,603

[45] Date of Patent: Oct. 6, 1992

[54] FALL-PROOF STRUCTURE TO PREVENT THE CONNECTING RODS OF A LAMP FROM FALLING DOWN

[76] Inventor: Hsuan-Yu Lee, P.O. Box 96-405, Taipei 10098, Taiwan

[21] Appl. No.: 782,410

[22] Filed: Oct. 25, 1991

[51] Int. Cl.[5] ..... F21V 21/26

[52] U.S. Cl. ..... 362/413; 362/927

[58] Field of Search ..... 362/285, 287, 410, 413, 362/414, 418, 419, 427

[56] References Cited

U.S. PATENT DOCUMENTS

| | | | |
|---|---|---|---|
| 2,346,234 | 4/1944 | Reynolds | 362/410 |
| 3,341,702 | 9/1967 | Neumann | 362/414 |
| 4,847,740 | 7/1989 | Laske | 362/418 |
| 4,974,139 | 11/1990 | Chin-Song | 362/418 |

*Primary Examiner*—Richard R. Cole

[57] ABSTRACT

A fall-proof structure to prevent the connecting rods of a lamp from falling down, in which the lower ends of the connecting rods each have a threaded end and two symmetrical lugs; the connecting rod is to be connected together with a threaded sleeve having a slot; the outer end of the threaded sleeve is mounted with an adjusting nut, a spring washer, and a washer; then, the threaded sleeve passes through a round hole of the base housing, and is mounted, inside the base housing, with a rotation-limiting disk, and a power-connecting plate; finally, the end of the connecting rod is mounted with a slip-resistant nut. The lower part of the base housing has a limiting groove for receiving the lug of the rotation-limiting disk. The tightness of the connecting rods can be adjusted by turning the adjusting nut; the rotation-limiting disk and the limiting groove in the base housing are used for preventing the connecting rods from falling down.

3 Claims, 2 Drawing Sheets

FALL-PROOF STRUCTURE TO PREVENT THE CONNECTING RODS OF A LAMP FROM FALLING DOWN

BACKGROUND OF THE INVENTION

1. Field of the Invention

This invention relates to a lamp, and particularly to a lamp with a fall-proof structure furnished between the base housing and the connecting rods; by means of the fall-proof structure, the swinging angle of the lamp can be adjusted at a suitable tightness, and the connecting rods would not fall down as a result of the weight of the lamp shade.

2. Description of the Prior Art

In the prior art, a table lamp usually comprises a lamp shade, a base, and connecting rod or rods. The connecting rod is used for connecting the base and the base housing of the lamp. The shape and material of the connecting rod vary with the shape of a table lamp, such as, a flexible pipe being used to connect the base and the lamp shade thereof; both ends of the flexible pipe each have a threaded end with a nut. The height of the table lamp may be varied by adjusting the flexible pipe; a connecting rod of such a type would not cause the lamp to fall down after being adjusted.

A fixed type of connecting pipe or pipes may be used to connect the base and the lamp shade; since the fixed type is unable to make any adjustment, there will be no falling-down to take place.

A balance rod may be used for connecting the base and the lamp shade of a lamp; the balance rod may be supporting rod or two parallel rods. The connection part between the supporting rods and the lamp shade is furnished with a pivotal joint to adjust the lamp shade at a given angle. The other end of the supporting rod has a balance weight. Between the base and the supporting rod, a pivotal joint is mounted between the lamp shade and the balance weight; the pivotal joint is a balance fulcrum between the base and the supporting rod of the lamp. By means of the pivotal joint, the lamp shade and the supporting rod can be adjusted at a given elevation angle, and the lamp shade can also be set at a given height. Since the balance rod can provide a balance effect, the lamp would not fall down upon adjusting the lamp shade.

As shown in FIG. 1, it is a conventional lamp having two connecting rods being pivotally mounted on the base; the two connecting rods are also electric conductive wires. The lower ends of the connecting rods each are connected with one side of the base housing by means of a nut; the nut has no positioning means; instead, two spring washers are mounted on both supporting rods respectively to provide a given tension. Quite often, the tension of the supporting rods would be reduced after using a period of time, and then the supporting rods would fall down as a result of the weight of lamp shade. During the lamp in lit-up condition, a fallen-down lamp might cause a fire.

SUMMARY OF THE INVENTION

This invention is an improvement of a table lamp which has two supporting rods for supporting the lamp shade and being used as power conductive wires; the fall-proof structure of the present invention also provides a tension adjustment means between the connecting rods and the base housing of the lamp.

The feature of the present invention is that both sides of the base housing each have an inner surface, of which the lower part has a limiting groove between two stop flanges. A rotation-limiting disk is mounted closely beside the inner surface. The rotation-limiting disk has a lug extended into the limiting groove. When the connecting rods are adjusted at a given angle, the rotation-limiting disk of the fall-proof structure would limit the swivel angle to prevent the lamp from falling down.

Another feature of the present invention is that each lower end of the two connecting rods has a threaded end and two symmetrical lugs, which are to be engaged with a slot of a threaded sleeve; one part of the sleeve mounted inside the base housing is mounted with the rotation-limiting disk, whereby the connecting rods can only swivel at a given angle as set with the rotation-limiting disk and the limiting groove.

Still another feature of the present invention is that, after the threaded sleeve being mounted on the connecting rod inside the base housing, the rotation-limiting disk and the power-connecting plate are mounted on the sleeve; then, a slip-resistant nut is mounted on the threaded end of the connecting rod; then, the slot of the threaded sleeve will be engaged with the lugs on the connecting rod. Whenever the connecting rods swivel, a single swinging assembly will turn.

A further feature of the present invention is that the part of the threaded sleeve mounted outside the base housing is mounted with a spring washer, a washer, and an adjusting nut; the adjusting nut is used for adjusting the tension between the connection rods and the base housing.

A still further feature of the present invention is that the power-connecting plate mounted on the threaded sleeve has a small lug to be connected with a power wire, which is then connected with a transformer to supply power to the lamp shade and the bulb.

DETAILED DESCRIPTION OF THE PREFERRED EMBODIMENT

Figure 1:
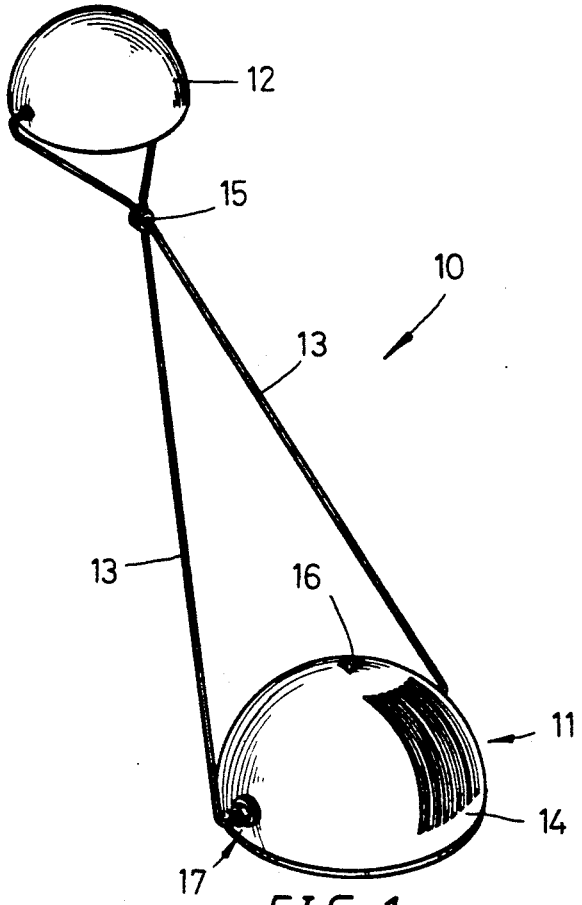
FIG. 1 is a perspective view of an embodiment according to the present invention.
Figure 2:
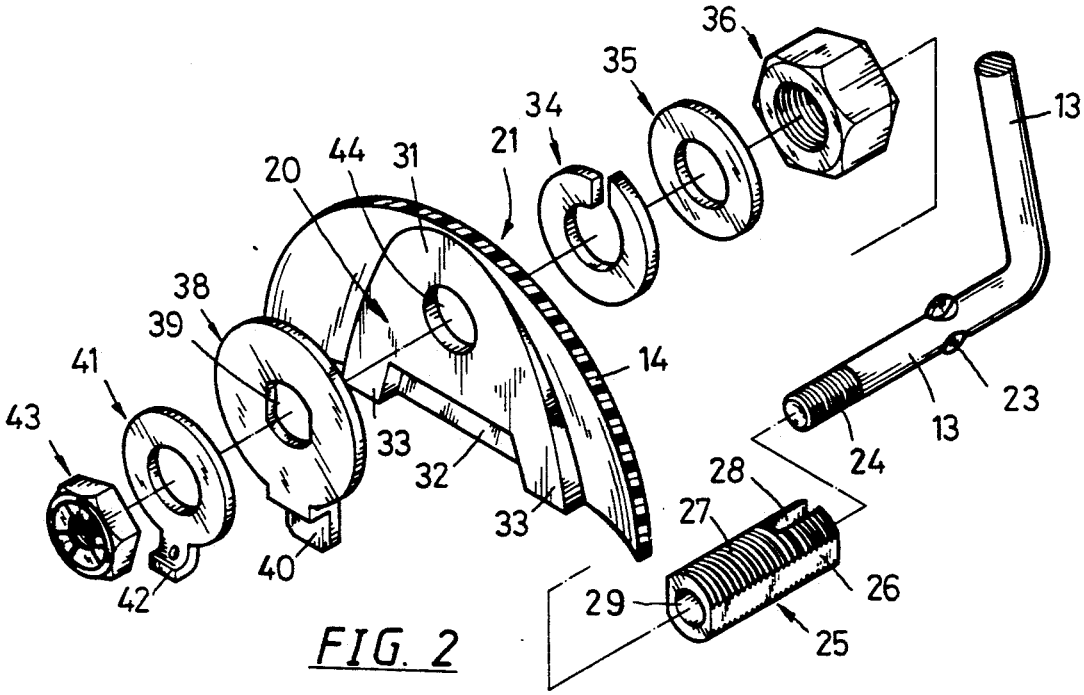
FIG. 2 is a disassembled view of the present invention.
Figure 3:
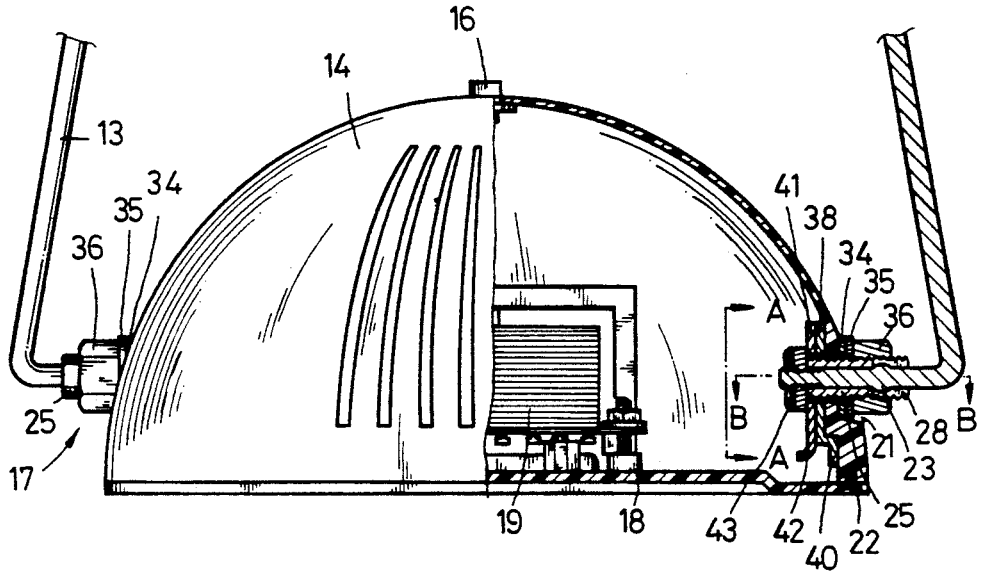
FIG. 3 is a fragmental section view of the fall-proof structure of the present invention.
Figure 4:
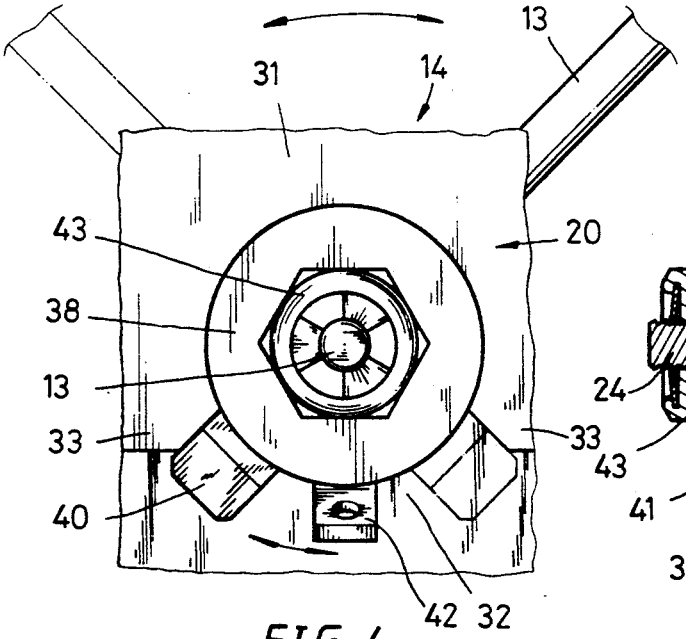
FIG. 4 is a plan view from the direction shown with line A—A in FIG. 3, showing the swinging limitation to the connecting rods.
Figure 5:
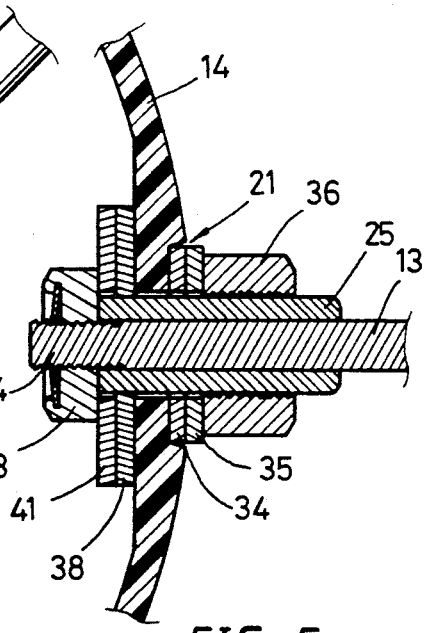
FIG. 5 is a fragmental section view taken along line B—B in FIG. 3.

A lamp 10 as shown in FIGS. 1 and 3 comprises a base 11, a lamp shade 12, and at least two connecting rods 13. Inside the base housing 14, there is a transformer 19 fixedly mounted on a base chassis 18 which is fixed to the bottom of the base housing 14 by means of screws 22. The power supply of the lamp is connected through a switch 16 on the base housing 14, the two connecting rods 13 and finally the lamp shade 12. An insulating fastener 15 is mounted between the two connecting rods 13 to prevent the rods from short-circuiting the power; the insulating fastener 15 can also provide the lamp with a better supporting function.

As shown in FIGS. 1 to 5, the fall-proof structure 17 according to the present invention has a base housing 14, of which both outer sides have two recess surfaces 21 respectively, and both inner sides each have an inner surface 20. Between the recess surface 21 and the inner surface 20, there is a round hole 44 for mounting a fall-proof structure 17. The inner surface 20 is substantially a plane surface 31. Both lower sides of the plane surface 31 each have a stop flange 33 to form into a limiting groove 32. The plane surface 31 is to be mounted with a rotation-limiting disk 38. The limiting groove 32 is used for receiving a lug 40 extended downwards from the rotation-limiting disk 38. An oblong hole 39 in the center of the rotation-limiting disk 38 is used to mount a threaded sleeve 25 which is a part of the fall-proof structure 17.

The connecting rods 13 each is mounted in a round hole 44 on one side of the base housing 14 so as to facilitate the installation of the fall-proof structure 17, which is to be mounted on the bent part of the connecting rod 13 near the round hole 44. The end of the connecting rod 13 is substantially a threaded end 24 with two symmetrical positioning lugs 23. The part of connecting rod 13 between the positioning lugs 23 and the threaded end 24 is used to mount a threaded sleeve 25, while the end of the connecting rod 13 is to be mounted with a slip-resistant nut 43.

The threaded sleeve 25 has outer threads 27 and two symmetrical flat surface 26; the outer threads 27 are used for mounting the adjusting nut 36, while the flat surfaces 26 are used for mounting a rotation-limiting disk 38. The threaded sleeve 25 has a center hole 29 for receiving the connecting rod 13. The threaded sleeve 25 has a slot 28 at one end thereof for receiving the positioning lugs upon the threaded sleeve 25 mounted on the connecting rod 13 so as to have the threaded sleeve 25 and the connecting rod 13 assembled together in a fixed manner.

The threaded sleeve 25 may be mounted on a connecting rod 13 having a smooth surface through the hole 29, and then the two parts are welded togethers as one fixed piece.

Before the threaded sleeve 25 is mounted around the connecting rod 13, an adjusting nut 36 is mounted on the outer threads 27 on the slot 28 portion; then, a washer 35 and a spring washer 34 are mounted on the inside end of the outer threads 27. Then, the threaded sleeve 25 is mounted on the connecting rod 13; both the sleeve 25 and the rod 13 pass through the round hole 44 of the base housing 14. The spring washer 34, the washer 35 and the adjusting nut 36 are mounted outside the recess surface 21 of the base housing 14. The threaded sleeve 25 extented inside the base housing 14 is mounted with a rotation-limiting disk 38 and a power-connecting plate 41; then, a slip-resistant nut 43 is mounted on the threaded end 24 of the connecting rod 13.

After the threaded sleeve 25 being mounted on the connecting rod 13, the various parts being mounted inside the base housing 14, and the rotation-limiting disk 38 and the power-connecting plate 41 being mounted on outer end of the threaded sleeve 25, the slip-resistant nut 43 is attached to the threaded end 24 of the connecting rod 13. The slot 28 of the threaded sleeve 25 is mated with the positioning lugs 23. As soon as the slip-resistant nut 43 is mounted in place, a fixed assembly between the threaded sleeve 25 and the connecting rod 13 is formed. Upon the adjusting nut 36 being adjusted, the assembly mounted around the threaded sleeve 25 will be pressed at a given position desired.

The positioning and adjustment of the fall-proof structure 17 are done by means of the slot 28 of the threaded sleeve 25 and the positioning lugs 23 of the connecting rod 13 being engaged together; after the slip-resistant nut 43 being mounted in place, the threaded sleeve 25 and the connecting rod 13 become one assembly. The rotation-limiting disk 38 mounted in the base housing 14 is mounted, through an oblong hole 39, on the threaded sleeve 25 to form a positioning assembly between the disk 38 and the connecting rod 13; the positioning assembly can be turned upon the connecting rod 13 being moved. After the rotation-limiting disk 38 being set in place by the adjusting nut 36, the disk 38 will closely be attached to the plane surface 31 of the inner surface 21. The lug 40 of the disk 38 will be placed in a limiting groove 32 between two stop flanges 33. The limiting groove 32 is used for limiting the rotationing angle of the disk 38, and in turn, the swinging angle of the connecting rod 13 will be limited.

In addition to having swinging limit, the fall-proof structure 17 should also have a suitable tightness during swivelling. The tightness adjustment of the structure 17 is obtained by means of the fixed connected between the threaded sleeve 25 and the connecting rod 13. Since the threaded sleeve 25 is mounted with a spring washer 34, a washer 35, and an adjusting nut 36, the tightness of structure 17 can be adjusted by turning the adjusting nut 36. Since the adjusting nut 36 is mounted outside the base housing 14, the tightness of the connecting rod 13 can be adjusted coveniently with a wrench any time.

The connecting rod 13 is used as a power wire; the threaded sleeve 25 is mounted with a power-connecting plate 41 having a small lug 42, whereby a power wire is attached; the other end of the power wire is connected with a transformer 19. The power is connected with the lamp shade 12 through the connecting rod 13.

According to the fall-proof structure 17, the swinging angle of the connecting rods 13 is to be limited by means of the limiting groove 32 between the stop flanges 33 under the inner surface 20 because of the turning angle of the rotation-limiting disk 38 being limited. By means of the adjusting nut 36 to regulate the tightness, the connecting rod 13 of the table lamp 10 mounted on the base 11 would not become loose and fall.

According to the aforesaid embodiments, the drawback of the conventional table lamp between the connecting rods and the base thereof can be improved, and the present invention is deemed practical and unique. However, any minor modification for the aforesaid embodiment will be construed being within the scope of claims of the present invention.

I claim:

1. A fall-proof structure to prevent a connecting rod of a lamp from falling down, and each said fall-proof structure being mounted on each side of a base housing of a lamp, and comprising:

said base housing being mounted with a threaded sleeve on an outer side thereof, having an inner surface with a round hole, having two stop flanges on lower both sides of said inner surface so as to form a limiting groove therebetween;

two connecting rods each having an upper end which is attached to a lamp shade, while a lower end being bent and mounted in a round hole on one side of said base housing, and an end part of said connecting rod having a threaded end and positioning lugs;

a threaded sleeve having a center hole for receiving one of said connecting rods, an outer thread part, two flat surfaces on both sides thereof, and a slot to be engaged with said positioning lugs;

an adjusting nut to be mounted on said threaded sleeve outside said base housing; and between said adjusting nut and said recess surface, a spring washer and a washer being mounted on said threaded sleeve;

a rotation-limiting disk being mounted on said inner surface in said base housing, and said disk having an oblong hole for receiving said threaded sleeve for positioning function, and having a lug;

a power-connecting plate being mounted on said threaded sleeve outside said rotation-limiting disk, and said plate having a small lug;

a slip-resistant nut being mounted on said threaded end of said connecting rod; and characterized in that said slot of said threaded sleeve being engaged with said symmetrical lugs; and said slip-resistant nut being used to fix said threaded sleeve on said connecting rod; and said lug of said rotation-limiting disk being set in said limiting groove to provide said connecting rod with a swinging limitation; and a part of said threaded sleeve outside said base housing being mounted with said spring washer, said washer, and said adjusting nut; said adjusting nut being mounted outside said base housing so as to facilitate adjusting the tightness of said connecting rods.

2. A fall-proof structure to prevent the connecting rods of a lamp from falling down as claimed in claim 1, wherein said threaded sleeve and end of said connecting rod are fixedly connected together by means of said hole and said slot in said threaded sleeve to be engaged with positioning lugs on said connecting rod.

3. A fall-proof structure to prevent the connecting rods of a lamp from falling down as claimed in claim 1, wherein said threaded sleeve and end of said connecting rod are fixedly connected together by means of a hole in said threaded sleeve for receiving said connecting rod, and by welding said threaded sleeve and said connecting rod.

* * * * *